US011719423B2

(12) United States Patent
Dyson et al.

(10) Patent No.: US 11,719,423 B2
(45) Date of Patent: Aug. 8, 2023

(54) LIGHTING DEVICE

(71) Applicant: Dyson Technology Limited, Wiltshire (GB)

(72) Inventors: Jacob Dyson, Bath (GB); Paul Andrew McLuckie, Bristol (GB); Simon Christopher Davey, Gloucester (GB); Vid Stiglic, Gloucester (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 17/270,968

(22) PCT Filed: Aug. 1, 2019

(86) PCT No.: PCT/GB2019/052156

§ 371 (c)(1),
(2) Date: Feb. 24, 2021

(87) PCT Pub. No.: WO2020/044010

PCT Pub. Date: Mar. 5, 2020

(65) Prior Publication Data

US 2021/0254817 A1 Aug. 19, 2021

(30) Foreign Application Priority Data

Aug. 31, 2018 (GB) ..... 1814191

(51) Int. Cl.

| | |
|---|---|
| ***F21V 21/28*** | (2006.01) |
| ***F21V 29/51*** | (2015.01) |
| ***F21S 6/00*** | (2006.01) |

(52) U.S. Cl.

CPC ..... *F21V 21/28* (2013.01); *F21S 6/003* (2013.01); *F21S 6/006* (2013.01); *F21V 29/51* (2015.01)

(58) Field of Classification Search

CPC ..... F21V 21/28; F21V 29/51; F21V 21/30; F21V 7/04; F21S 6/003; F21S 6/006; F21Y 2115/10

See application file for complete search history.

(56) References Cited

U.S. PATENT DOCUMENTS 2,048,313 A * 7/1936 Adolfson ..... F21V 21/26 362/269
2,164,390 A * 7/1939 Dickerson ..... A61C 1/02 285/275

(Continued)

FOREIGN PATENT DOCUMENTS

CN 201062733 Y 5/2008
CN 201351829 Y 11/2009

(Continued)

OTHER PUBLICATIONS

International Search Report and Written Opinion dated Sep. 6, 2019, directed to International Application No. PCT/GB2019/052156; 16 pages.

(Continued)

*Primary Examiner* — Zheng Song
(74) *Attorney, Agent, or Firm* — Faegre Drinker Biddle & Reath LLP

(57) ABSTRACT

A lighting device includes a light source, a base and an articulated support. The support has a first arm which is rotatable relative to the base about a first axis, a second arm upon which the light source is mounted, and a joint section which connects the second arm to the first arm for movement relative thereto about a second axis which is parallel to the first axis. The second arm is also moveable relative to the joint section about a third axis which intersects, and is orthogonal to, the second axis to change the orientation of the light source relative to the base.

6 Claims, 16 Drawing Sheets

(56) References Cited

U.S. PATENT DOCUMENTS

| | | | | | |
|---|---|---|---|---|---|
| 2,242,303 | A * | 5/1941 | Irmischer | F21V 21/26 | 362/418 |
| 2,488,898 | A * | 11/1949 | Brasty | F21V 21/26 | 248/282.1 |
| 2,665,330 | A * | 1/1954 | Wong | F21S 8/035 | 439/373 |
| 3,164,355 | A * | 1/1965 | Seitz | F16M 11/10 | 474/59 |
| 3,983,386 | A * | 9/1976 | Schallenkammer | F21S 6/002 | 362/427 |
| 4,121,280 | A * | 10/1978 | Chapman | F21V 23/02 | 362/418 |
| 4,347,557 | A * | 8/1982 | Warshawsky | F21V 21/26 | 362/427 |
| 4,381,538 | A * | 4/1983 | Warshawsky | F21V 21/26 | 362/427 |
| 4,449,169 | A * | 5/1984 | Warshawsky | F21S 6/002 | 362/238 |
| 4,692,849 | A | 9/1987 | Le Vantine | | |
| 4,726,552 | A * | 2/1988 | Warshawsky | F21S 6/002 | 248/122.1 |
| 4,821,159 | A * | 4/1989 | Pike | F16M 11/2014 | 362/427 |
| 4,880,193 | A * | 11/1989 | Warshawsky | F21S 6/003 | 248/122.1 |
| 5,097,400 | A * | 3/1992 | Cvek | F16M 11/105 | 362/287 |
| 5,342,137 | A | 8/1994 | Peng | | |
| 6,398,172 | B1 * | 6/2002 | Rousek | F16M 11/10 | 248/121 |
| 7,938,560 | B2 | 5/2011 | Hsu | | |
| 8,002,448 | B2 | 8/2011 | Chen | | |
| 9,274,270 | B2 | 3/2016 | Vissenberg et al. | | |
| 9,477,029 | B2 | 10/2016 | Parker et al. | | |
| 9,605,800 | B2 * | 3/2017 | Huang | B65B 55/00 | |
| 9,950,662 | B2 | 4/2018 | Moon | | |
| 2004/0062048 | A1 * | 4/2004 | Eusterbrock | F21S 6/006 | 362/411 |
| 2004/0125597 | A1 | 7/2004 | Einav | | |
| 2008/0232107 | A1 | 9/2008 | Hsu | | |
| 2009/0225558 | A1 * | 9/2009 | Atkinson | F16M 11/10 | 362/419 |
| 2009/0318770 | A1 | 12/2009 | Marka et al. | | |
| 2011/0141737 | A1 * | 6/2011 | Gu | F21V 17/007 | 362/249.1 |
| 2011/0228538 | A1 | 9/2011 | Yu et al. | | |
| 2014/0133172 | A1 | 5/2014 | Vissenberg et al. | | |
| 2017/0261191 | A1 | 9/2017 | Kawachi et al. | | |
| 2018/0058647 | A1 | 3/2018 | He et al. | | |
| 2018/0160891 | A1 * | 6/2018 | Ahearn | A61B 90/30 | |
| 2019/0145473 | A1 * | 5/2019 | Puterbaugh | F16M 11/10 | 188/218 R |
| 2021/0325009 | A1 | 10/2021 | Dyson et al. | | |
| 2022/0357001 | A1 | 11/2022 | Dyson et al. | | |

FOREIGN PATENT DOCUMENTS

| | | | |
|---|---|---|---|
| CN | 101806994 | A | 8/2010 |
| CN | 102094894 | A | 6/2011 |
| CN | 102997105 | A | 3/2013 |
| CN | 103133967 | A | 6/2013 |
| CN | 105927894 | A | 9/2016 |
| CN | 106594570 | A | 4/2017 |
| CN | 206592990 | U | 10/2017 |
| CN | 206943903 | U | 1/2018 |
| CN | 207094300 | U | 3/2018 |
| CN | 207112466 | U | 3/2018 |
| DE | 19516758 | A1 | 11/1996 |
| DE | 102007058173 | A1 | 6/2009 |
| JP | 2009-87765 | A | 4/2009 |
| JP | 2011-204497 | A | 10/2011 |
| JP | 5709360 | B2 | 4/2015 |
| WO | 2011/118354 | A1 | 9/2011 |
| WO | 2014/074073 | A1 | 5/2014 |

OTHER PUBLICATIONS

Search Report dated Feb. 13, 2019, directed to GB Application No. 1814191.1; 2 pages.

International Search Report and Written Opinion received for PCT Patent Application No. PCT/GB2019/052155, dated Sep. 6, 2019, 12 pages.

Search Report dated Feb. 13, 2019, directed to GB Application No. 1814190.3; 1 page.

Examination Report under Section 18(3) received for GB Patent Application No. 1909010, dated May 27, 2021, 2 pages.

International Search Report and Written Opinion received for PCT Patent Application No. PCT/GB2020/050965, dated Jun. 10, 2020, 14 pages.

Search Report received for GB Application No. 1909010, dated Dec. 18, 2019, 1 page.

Office Action received for Chinese Patent Application No. 201980050060.5, dated Jul. 27, 2022, 16 pages (9 pages of English Translation and 7 pages of Original Document).

Notification Of Reason(S) For Refusal received for Korean Patent Application No. 10-2021-7007525, dated Mar. 30, 2023, 12 pages (6 pages of English Translation and 6 pages of Original Document).

* cited by examiner

LIGHTING DEVICE

REFERENCE TO RELATED APPLICATIONS

This application is a national stage application under 35 USC 371 of International Application No. PCT/GB2019/052156, filed Aug. 1, 2019, which claims the priority of United Kingdom Application No. 1814191.1, filed Aug. 31, 2018, the entire contents of each of which is incorporated herein by reference.

FIELD OF THE DISCLOSURE

The present invention relates to a lighting device and in a particular to a multi-functional lighting device in which the lighting device may be placed in one of a number of different configurations.

BACKGROUND OF THE DISCLOSURE

Floor-standing, desk-standing and wall-mounted lamps for illuminating a task area include the well-known Anglepoise® lamp, in which a light source is mounted on an articulated support. The support comprises a first arm which is pivotably mounted to a stand, and a second arm which is pivotably mounted to the first arm. The light source is mounted to an end of the second arm for pivoting movement relative thereto. Each of the pivot axes is generally parallel, and together enable the lamp to be placed in a range of different configurations for optimising the illumination of a task area located beneath the light source.

SUMMARY OF THE DISCLOSURE

In a first aspect, the present invention provides a lighting device comprising a light permeable body having an aperture through which light enters the body; and a light source moveable relative to the body to enable the lighting device to adopt selectively one of a first configuration in which the light source is positioned over the aperture to illuminate the interior of the body, and a second configuration in which the light source is spaced laterally from the aperture.

When the light source is positioned to illuminate the interior of the light permeable body, the lighting device is placed in a first, or "room lighting", configuration, in which a room or other external environment is illuminated by light which has passed through the light permeable body. Depending on the material from which the light permeable body is formed, this can enable the room to be illuminated by a relatively diffuse light emitted from the external surface of the light permeable body. When the light source is moved to a position which is remote from the light permeable body, the lighting device is placed in a second, or "task lighting", configuration, in which a room, task area or other work surface is illuminated directly by light emitted from the light source. This can enable the task area to be illuminated by a relatively intense light emitted by the light source.

In the first configuration of the lighting device, the light source is positioned so as to illuminate the interior of the light permeable body. In this configuration, the light source is preferably arranged external to the light permeable body to facilitate a rapid transition between the configurations of the lighting device. The light permeable body is preferably hollow, and in one embodiment is in the form of a pipe or tube having an internal surface which is illuminated by the light source. The tube may have a regular or irregular cross-section, which may be constant or varying along the length of the tube. For example, where the tube has a circular cross-section, the tube may be cylindrical or frusto-conical in shape. Where the tube has a regular cross-section, the light source preferably has the same external diameter or shape as the body so that the body and the light source present a uniform appearance when the lighting device is in its first configuration.

The light permeable body preferably comprises an open end which defines the aperture through which light can enter the body, and in the first configuration of the lighting device the light source is preferably positioned over the open end of the body. This allows the light source to illuminate the interior of the body, with the light received by the body passing through the body prior to emission from the body. In this configuration the open end of the body is preferably substantially fully occluded by the light source so that substantially all of the light emitted by the light source passes through the body before entering the room or other external environment in which the lighting device is located. The body preferably comprises a closed end which is opposite to the open end, and is preferably located adjacent to, or closed by, a base of the device. The base may be wall-mountable, desk-mountable or floor-standing. The base may comprise additional functionality of the lighting device, such as one or more of a clock, a USB charger, and a proximity sensor. The open end and the closed end of the body are preferably substantially parallel and orthogonal to a longitudinal axis of the body.

The body may be formed entirely from translucent material, but alternatively the body may comprise one or more translucent sections. The translucent sections may be formed from glass or plastics material, such as polycarbonate. Alternatively, the body may be perforated, or may comprise one or more perforated sections. The perforated body, or the perforated sections of the body, may be formed from metallic or plastics material. As a further alternative, the body may comprise a translucent tube or pipe and a perforated sleeve which extends about, or surrounds the tube. This can allow perforations to be distributed evenly about the external surface of the body, with the (inner) tube providing structural stability to the body. The translucent tube may be formed from plastics material, such as a polycarbonate material, and the sleeve may be formed from an opaque plastics or metallic material.

The body may include means for directing light towards one or more light permeable sections of the body. The light directing means may comprise at least one light reflecting member located within the body. In a preferred embodiment, the light directing means comprises an elongate light reflecting member which extends substantially the length of the body, and which comprises opposing reflective surfaces which each guide light towards a respective light permeable section of the body. Depending on the configuration of the body, each reflective surface may be arranged to direct light towards a respective translucent section of the body or a respective perforated section of the body. The reflective surfaces may be planar surfaces, or curved, preferably concave surfaces, to guide light towards the light permeable sections of the body in an optimal direction for reducing losses within the body. In the preferred embodiment, the light directing means comprises an elongate member having opposing reflective surfaces. The elongate member is preferably formed from a rigid material to increase the structural stability of the body, especially where the body comprises one or more perforated sections. For example, the elongate member may be in the shape of an I-beam. The elongate member may be formed from a metallic material, such as aluminium, or may have a metallic coating which provides the reflective surfaces.

Alternatively, the light directing means may comprise a light pipe, from which light is emitted towards one or more light permeable sections of the body through imperfections or irregularities in the wall of the light pipe.

The lighting device preferably comprises a support which supports the light source. The light source may be moveable along the support as the lighting device adopts different configurations. For example, the light source may be slid along the support by the user from a position in which the interior of the body is illuminated by the light source to a position in which a task area is illuminated directly by the light source. Alternatively, the support may be moveable relative to the light permeable body to adjust the configuration of the lighting device. The support may be flexible, and may be bent, twisted or otherwise changed in shape to move the light source relative to the body. As another alternative, the support may be translatable relative to the body. For example, the support may be slidable so that the light source moves relative to the body along a linear or curved path. As a further alternative, the support may be pivotable so that the light source may be moved along an arcuate or circular path. A pivoting support is preferable as the user only has to swing the support relative to the body in order to adjust the configuration of the lighting device.

The support may be connected to the base so as to be spaced from the body, and the support may be moveable relative to the base, and to the body, so as to change the configuration of the lighting device. The support may be pivotable relative to the body about a pivot axis which is substantially parallel to a longitudinal axis of the body. As the lighting device moves from the first configuration to a second configuration, an arc which is swept by the support may thus be located in a plane which is orthogonal to the longitudinal axis of the body, and which is parallel to a plane containing the longitudinal axis of the support.

In a preferred embodiment, the support is in the form of an articulated support which is connected to the body. The support extends outwardly from the body, preferably substantially orthogonally to the longitudinal axis of the body. The support is preferably connected to the body adjacent to the open end or aperture of the body. The support preferably comprises a first arm which is connected to the body, and a second arm which supports the light source, and which is moveable relative to the first arm. The second arm is preferably pivotable relative to the first arm about a pivot axis which is substantially parallel to the longitudinal axis of the body. The arms of the support are preferably arranged such that when the lighting device is in its first configuration, the arms of the support are substantially parallel, with the second arm overlying the first arm. In a fully extended second configuration of the device, the arms of the support are preferably in a substantially linear arrangement to maximise the distance between the light source and the body. Again, as the second arm moves to change the configuration of the lighting device, an arc which is swept by the second arm is preferably located in a plane which is orthogonal to the longitudinal axis of the body, and which is parallel to a plane containing the longitudinal axis of the second arm.

The body may be rotatable relative to the base. This can allow the direction in which the first arm protrudes from the support relative to the base to be adjusted, which in turn can increase the number of different positions which the light source may adopt relative to the base when the lighting device is in a task lighting configuration. The body is preferably rotatable about its longitudinal axis. Alternatively, the support may be mounted on the body so that the first arm is rotatable relative to the body about the longitudinal axis of the body. In both of these alternatives, the support is rotatable relative to the base about the longitudinal axis of the body. The longitudinal axis of the body preferably passes through the end of the support which is connected to the body, and so the support is preferably rotatable relative to the base about an axis which passes through the end of the support, and which is preferably orthogonal to the support.

The support may be detachable from the body. A control circuit is preferably located in the base or in the body, and a wire or other electrical conductor preferably extends from the control circuit to a first electrical contact located on the body, preferably adjacent the open end of the body. A second electrical contact is located on the support for engaging the first electrical contact when the support is attached to the body. A wire or other electrical conductor preferably extends through the arms of the support to connect the light source to the second electrical contact.

The light source may be locatable in one of two different positions relative to the body; a first position when the lighting device is in the first configuration, and a second position when the lighting device is in the second configuration. These first and second positions may be located at either end of the extremity of the movement of the light source relative to the body. A biasing mechanism may be provided for urging the light source towards one of its first and second positions depending on the current position of the light source relative to the body.

Alternatively, the light source may adopt one of a range of different second positions relative to the body, and so the lighting device may adopt a range of different second, or task lighting, configurations. The user can choose the position to be adopted by the light source depending on, for example, the location of the task area relative to the body. The arms of the support may be arranged to move freely relative to the base so that the user can locate the light source at any desired position on the path along which the light source moves relative to the base. In order to reduce the likelihood of the light source being moved inadvertently once positioned by the user, the lighting device may include an indexing mechanism for moving the light source relative to the body between different positions in a series of step movements. For example, the lighting device may include a rack and pinion mechanism or a cam mechanism for moving the light source between different positions. The rack gear may be straight or curved. Alternatively, the lighting device may comprise means for fastening the second arm to the first arm to inhibit relative movement between the arms of the support. For example, the lighting device may comprise a bolt or grub screw for fastening the second arm to the first arm. In a preferred embodiment, the lighting device comprises means for retaining the second arm in one of a number of positions relative to the first arm. For example, the lighting device may comprise a detent connected to the second arm so as to move with the second arm relative to the first arm, which enters one of a number of recesses provided on a component connected to the first arm as the second arm moves relative to the first arm to retain the second arm relative to the first arm.

The support preferably comprises a joint section for connecting the second arm to the first arm. The joint section is preferably mounted on a spigot upstanding from the end of the first arm which is remote from the body, so that the joint section and the second arm rotate together about the pivot axis. This spigot may be located directly on the first arm, or located on another joint section which is connected to the end of the first arm which is remote from the body.

A biasing mechanism may be provided for urging the lighting device towards its first configuration depending on the position of the light source relative to the body. The biasing mechanism may be arranged to contact the second arm to move the lighting device into its first configuration. In a preferred embodiment, the biasing mechanism is arranged to engage the joint section to move the lighting device into its first configuration depending on the position of the light source relative to the body, and more preferably depending on the angular position of the second arm relative to the first arm. In a preferred embodiment, the biasing mechanism comprises a detent which is mounted on the first arm, and which is biased towards the joint section. A spring or other resilient member may be provided for urging the detent towards the joint section. The joint section may comprise a track, preferably a circular track, which extends about the pivot axis, and which is engaged by the detent. A recess is preferably formed on the track, the recess being shaped to receive the detent depending on the angular position of the second arm relative to the first arm. The recess is preferably curved or concave in shape. The detent preferably comprises a circular roller which engages, and is urged towards, the track. As the lighting device moves towards the first configuration, the detent enters the recess in the track to urge the lighting device into its first configuration to ensure accurate alignment between the light source and the body in that configuration of the lighting device.

In a preferred embodiment, the second arm is also moveable relative to the joint section. This can further increase the number of different positions and/or orientations which the light source may adopt relative to the body when the lighting device is in a task lighting configuration.

In the first configuration of the lighting device, the light source is oriented relative to the body so that an optical axis of the light source is preferably substantially parallel to the longitudinal axis of the body. When in a task lighting configuration, the light source may remain in this orientation relative to the body. Alternatively, the second arm may be moved relative to the joint section about a third axis which is angled to, and preferably orthogonal to, the second axis. This allows the orientation of the light source to be adjusted. The second arm is preferably rotatable about the third axis, preferably through at least 180°, more preferably through at least 270°, and in a preferred embodiment through around 360°. This can allow the orientation of the optical axis of the light source relative to the body to be adjusted so that the lighting device may adopt either a "downlighting" configuration for illuminating a work surface or task area, or an "uplighting" configuration for general room illumination by reflection of light, emitted directly by the light source, from secondary room surfaces such as walls and/or a ceiling. The optical axis of the light source may also be angled, or inclined, relative the longitudinal axis of the body when in a downlighting configuration, for example to optimise the illumination of reading material or other task area, or when in an uplighting configuration, for example to optimise the illumination of a wall or other secondary room surface. These may be referred to as angled configurations of the lighting device.

The device may comprise means for retaining the second arm in one or more orientations relative to the joint section. For example, the joint section may comprise a shaft upon which the second arm is mounted, and about which the second arm rotates relative to the joint section. The shaft preferably comprises one or more shaft recesses angularly spaced about the shaft, with the second arm comprising a detent which is received by one of the recesses to retain the second arm in a said orientation. For example, the shaft may comprise two shaft recesses which are spaced apart by 180°, and which are arranged such that in each of these orientations the light source is positioned so that the optical axis of the light source is parallel to the longitudinal axis of the body. The recesses are preferably shaped so that the detent can be removed from a shaft recess through manual rotation of the second arm relative to the joint section. Alternatively, the shaft may comprise a single such recess positioned so as to retain the lighting device in a downlighting configuration.

The third axis preferably intersects the second axis, preferably substantially orthogonally. The third axis is preferably parallel to a longitudinal axis of the second arm.

In a second aspect, the present invention provides a lighting device comprising a light source; a base; and a support; wherein the support comprises a first arm which is rotatable relative to the base about a first axis, a second arm upon which the light source is mounted, and a joint section which connects the second arm to the first arm for movement relative thereto about a second axis which is parallel to the first axis; and wherein the second arm is moveable relative to the joint section about a third axis which intersects, and is orthogonal to, the second axis.

The support is preferably mounted on a body which is rotatable relative to the base. The body is preferably rotatable relative to the base about its longitudinal axis. The support preferably extends substantially orthogonal to the longitudinal axis of the body.

The second arm preferably comprises a heat pipe for conveying heat away from the light source. The heat pipe preferably extends parallel to the longitudinal axis of the second arm. The second arm preferably comprises side walls which are located on opposite sides of the heat pipe, and which are preferably arranged substantially parallel to the heat pipe. The side walls preferably define therebetween at least one aperture above, and extending along the length of the heat pipe and through which heat emitted from the heat pipe enters the ambient atmosphere. The side walls may define a single aperture which extends above at least half of the heat pipe, or a series of apertures which are arranged along the length of the heat pipe.

To convey heat away from the heat pipe when the lighting device is in an angled configuration, the side walls each comprise at least one aperture through which heat can be radiated into the external environment. Each side wall may comprise a series of apertures, the apertures preferably having substantially the same size and shape, and with a consistent spacing between adjacent apertures so that there is a relatively even distribution along the side wall of the heat radiated from the heat pipe. Each side wall may comprise at least four apertures, and preferably between four and ten apertures, the selected number of apertures depending on the length of the heat pipe. In a preferred embodiment, each side wall comprises five apertures.

In a third aspect, the present invention provides a lighting device comprising a light source having an optical axis; a body having a longitudinal axis; a support mounted on the body, the light source being mounted on a section of the support which is rotatable relative to the body to change the orientation of the optical axis of the light source relative to the longitudinal axis of the body; wherein said section of the support comprises a heat pipe for conveying heat away from the light source, the heat pipe being located between side walls of the support, and a plurality of apertures through which heat radiated from the heat pipe may enter the external environment, the plurality of apertures comprising at least one first aperture located between the side walls and at least one second aperture formed in each of the side walls.

Features described above in connection to the first aspect of the invention are equally applicable to each of the second and third aspects of the invention, and vice versa. The terms "horizontal", "vertical", "laterally", "upper" and "lower" are used in the context of the present application to refer to relative orientations or positions of components of the lighting device when in normal use.

BRIEF DESCRIPTION OF THE FIGURES

Preferred features of the invention will now be described, by way of example only, with reference to the accompanying drawings, in which.

DETAILED DESCRIPTION OF THE DISCLOSURE

Figure 1:
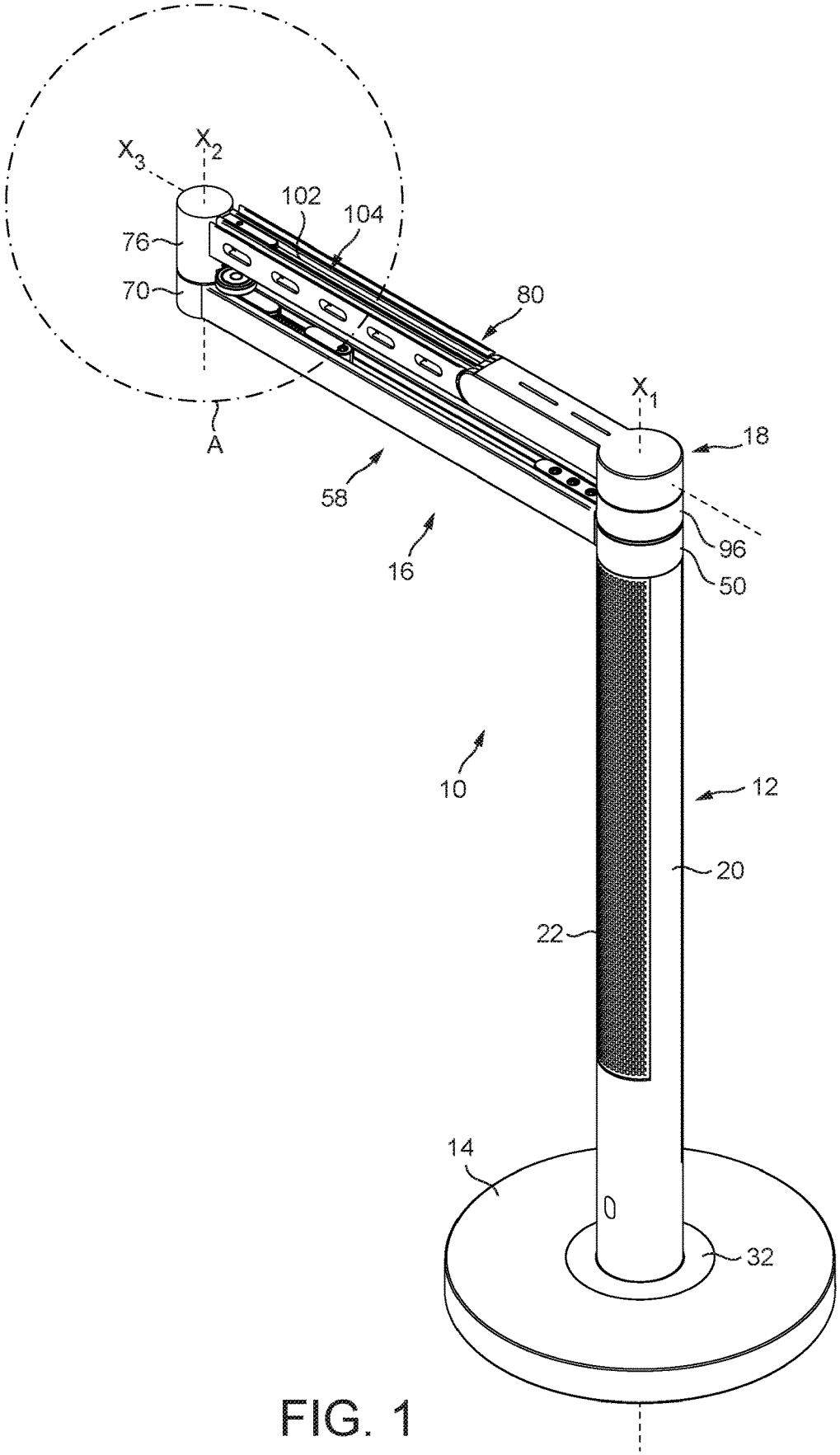
FIG. 1 is a perspective view, from above, of a lighting device, in which the lighting device is in a room lighting configuration.

An embodiment of a lighting device 10 of the present invention will be described with reference to FIGS. 1 to 18. In this embodiment, the lighting device 10 is in the form of a desk lamp, but alternative embodiments include a floor-standing lamp and a wall-mounted light. In overview, the lighting device 10 comprises a body 12 mounted on a base 14, a support 16 connected to the body 12, and a light source 18 which is supported by the support 16. The support 16 is articulated, which allows a user to move the light source 18 relative to the body 12 to allow the lighting device 10 to adopt a range of different configurations.

Figure 3:
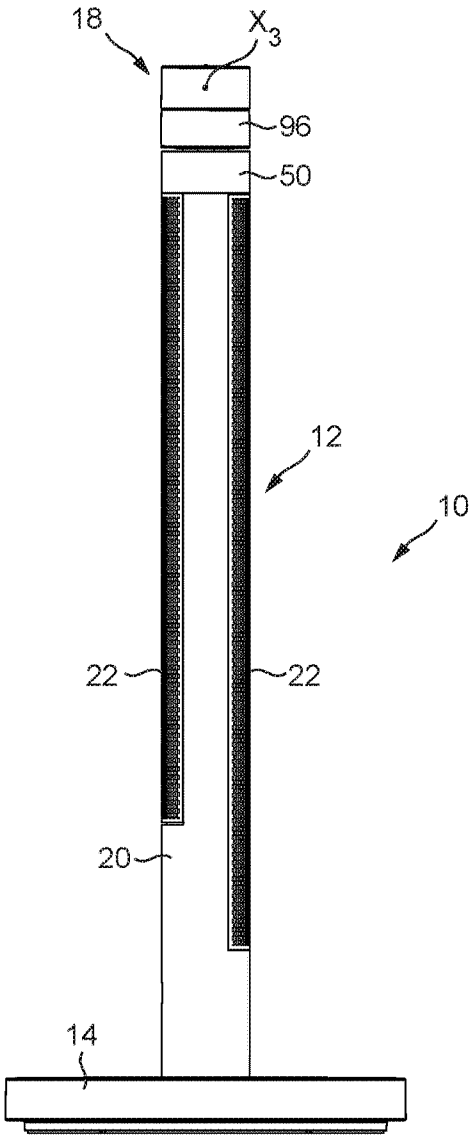
FIG. 3 is a side view of the lighting device as illustrated in FIG. 1.
Figure 2:
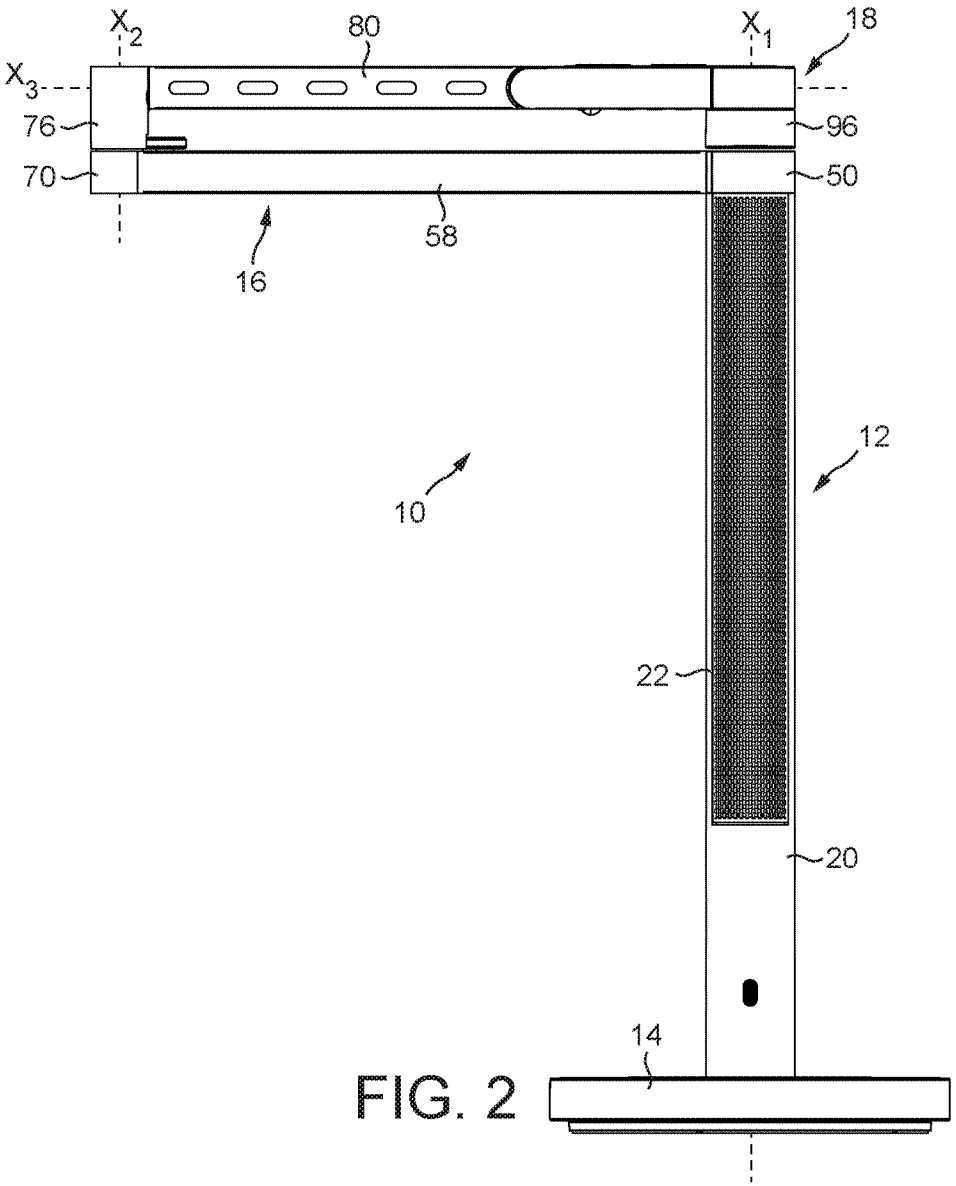
FIG. 2 is a front view of the lighting device as illustrated in FIG. 1.
Figure 4:
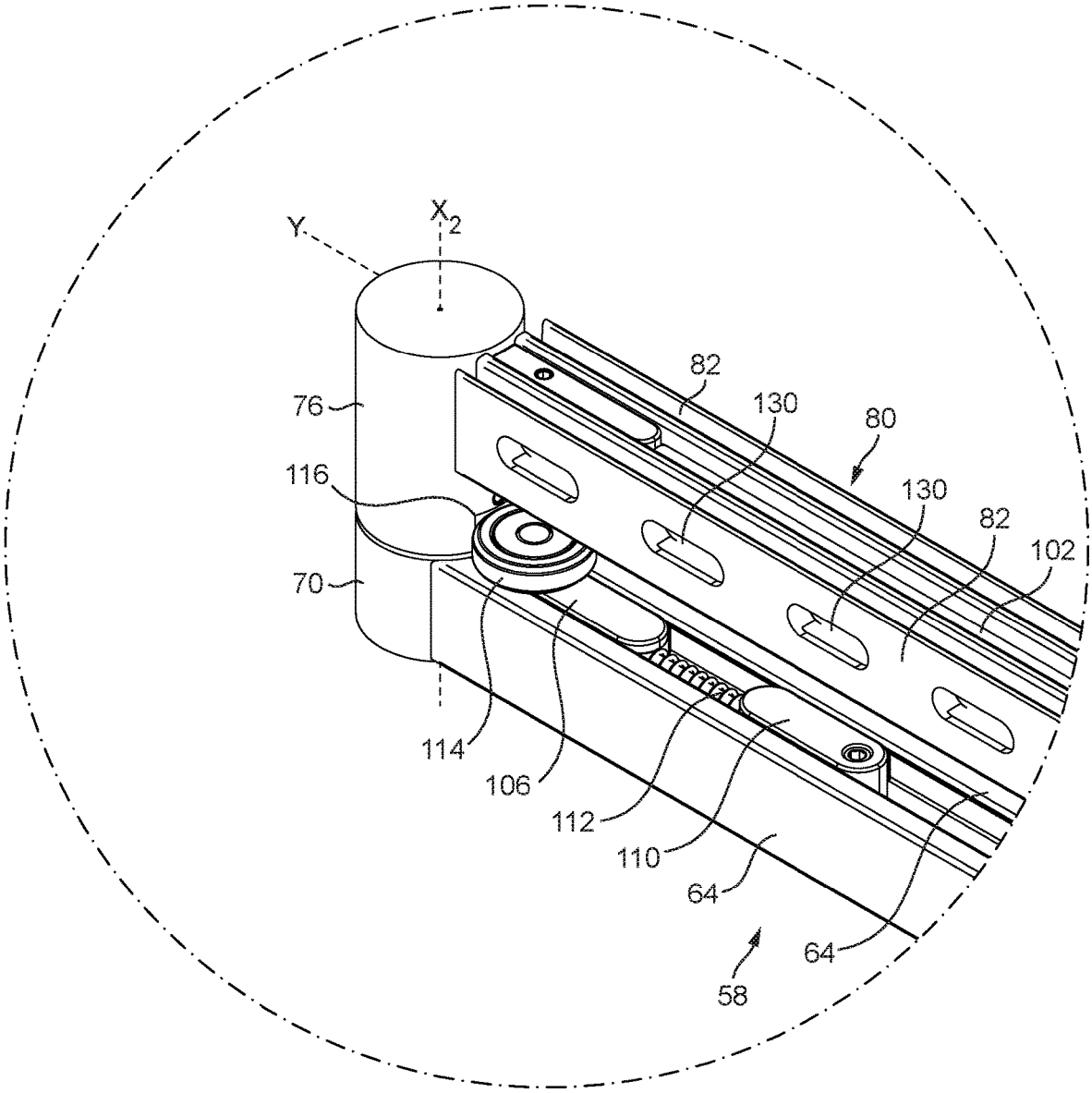
FIG. 4 is a close up of area A indicated in FIG. 1.
Figure 5:
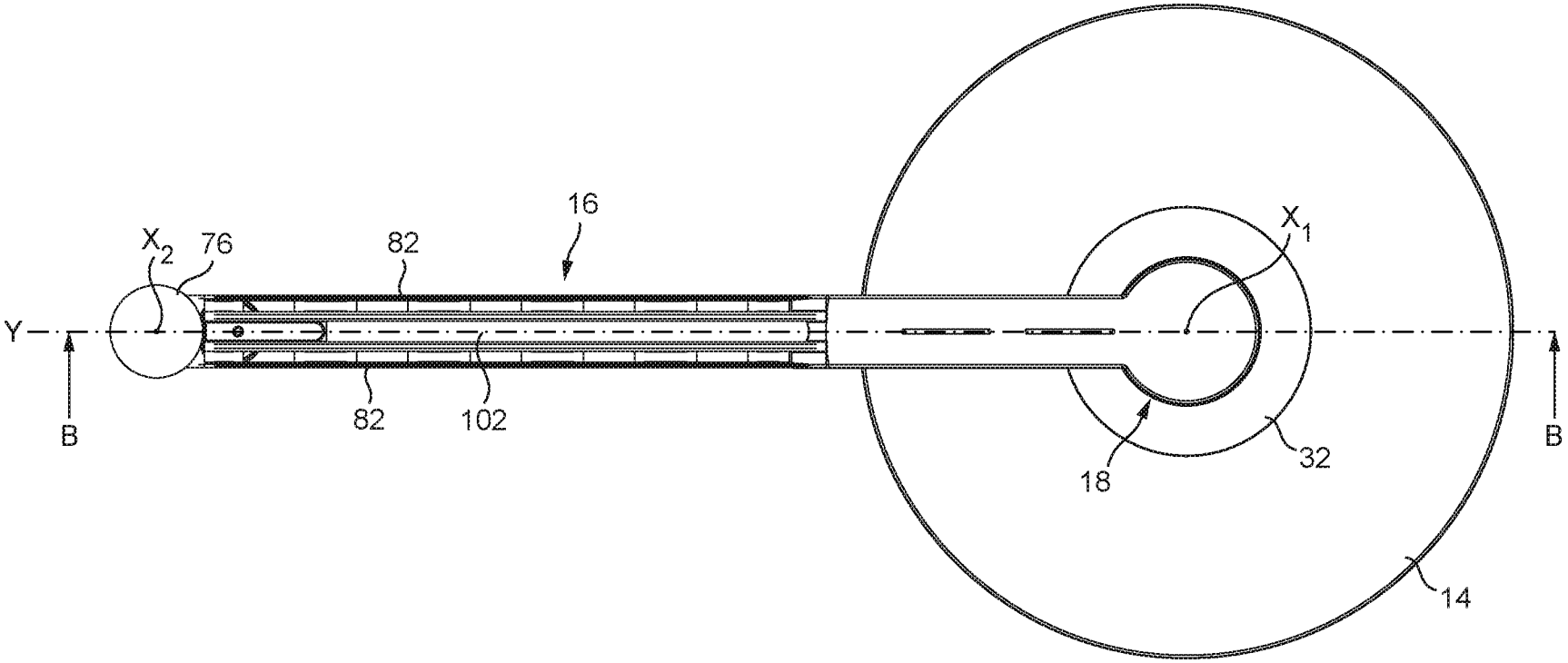
FIG. 5 is a top view of the lighting device as illustrated in FIG. 1.

With reference first to FIGS. 1 to 3, the body 12 comprises a tubular housing 20 which in this embodiment is in the form of a pipe having a constant circular cross-section. The housing 20 is mounted on the base 14 so that the longitudinal axis of the housing 20 extends orthogonal to the base 14, with the base 14 being shaped such that the housing 20 is vertical when the base 14 is located on a horizontal surface. In this embodiment, the housing 20 is formed from an opaque material, which may be a plastics or metallic material. The housing 20 includes light permeable sections in the form of two perforated sections 22 which are located on opposite sides of the housing 20 and which each extend partially about the longitudinal axis of the body 12 and at least half way along the length of the body 12. As an alternative, the body 12 may comprise a transparent tubular housing, again preferably in the form of a pipe having a constant circular cross-section, and a perforated sleeve extending about the housing.

Figures 6, 7:
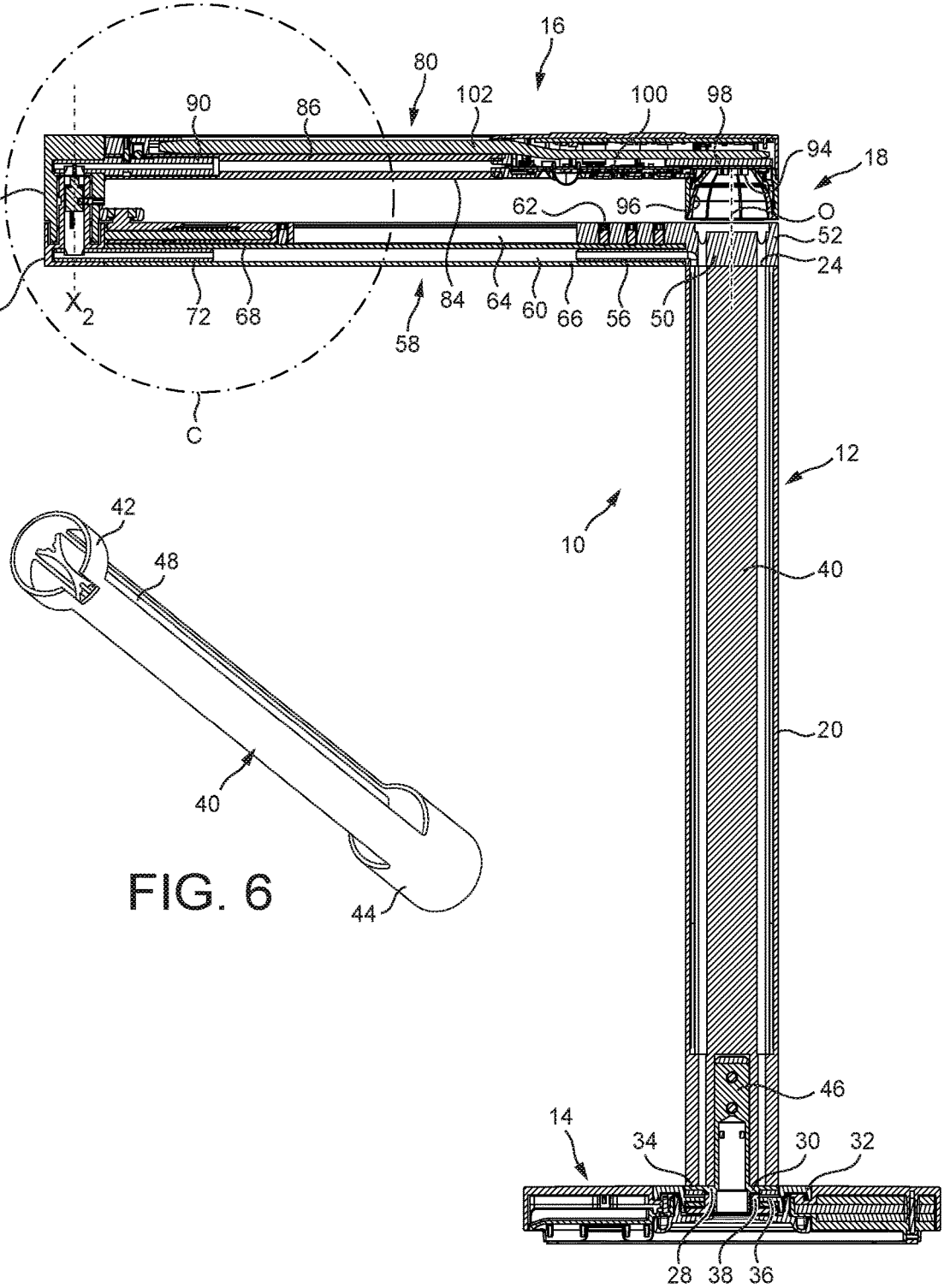
FIG. 6 is a perspective view of a light reflective member which is housed within a body of the lighting device.
FIG. 7 is a sectional view taken along line B-B in FIG. 5.
Figure 11:
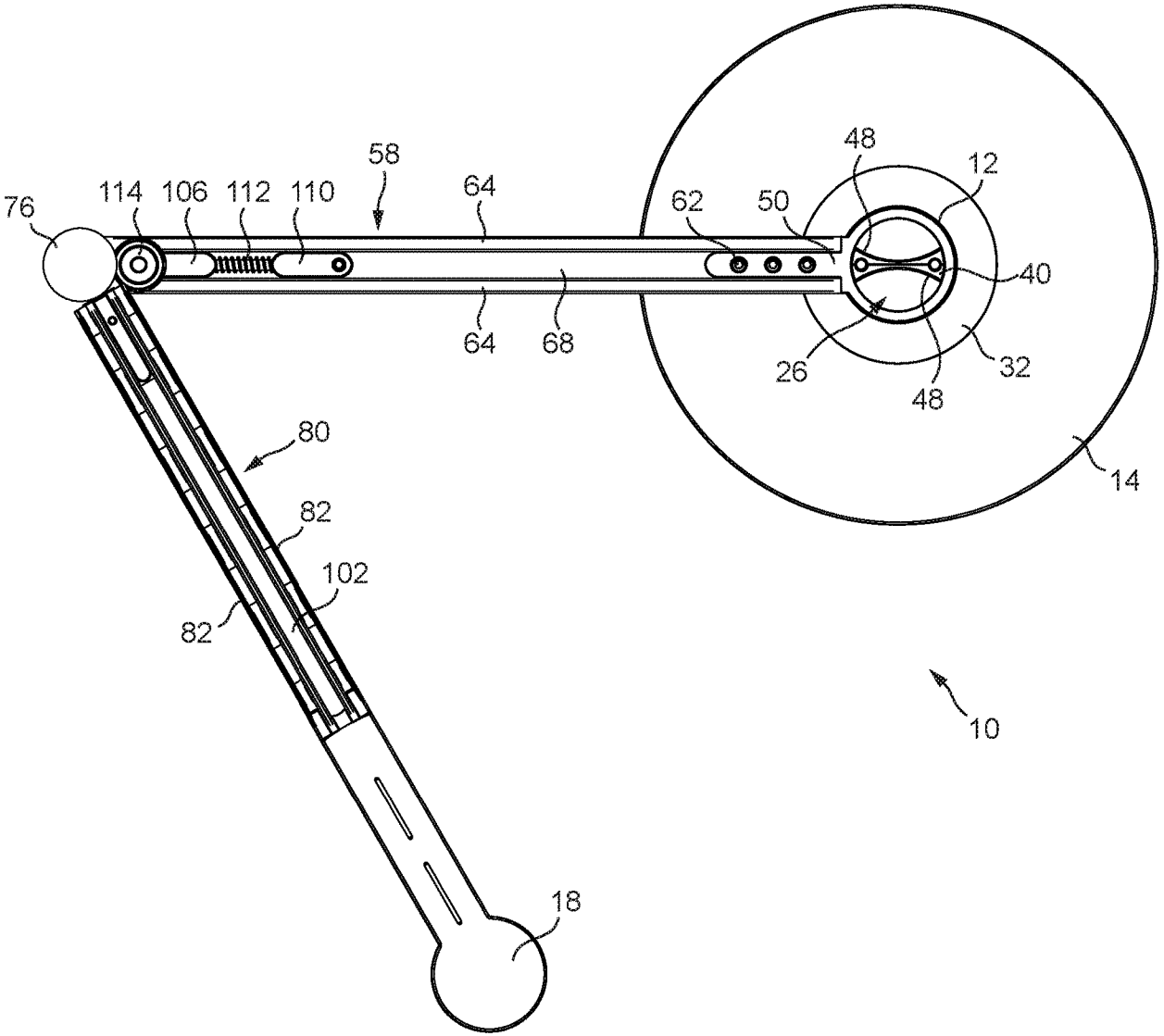
FIG. 11 is a top view of the lighting device illustrated in FIG. 9.

As shown in FIG. 11, the housing 20 has an open upper end 24 which is remote from the base 14, and which defines an aperture 26 through which light enters the body 12 from the light source 18. The upper end 24 of the housing 20 is located in a plane which is substantially orthogonal to the longitudinal axis of the housing 20. With reference also to FIG. 7, the lower end 28 of the body 12 is closed by a stop 30. During assembly, the stop 30 is received by an annular central section 32 of the base 14 so that an annular flange 34 of the stop 30 overlies an inner annular flange 36 of the central section 32 of the base 14. A threaded cap 38 is then secured to lower end of the stop 30. The inner annular flange 36 becomes sandwiched between the stop 30 and the cap 38, which secures the body 12 to the base 14 whilst enabling the body 12 to rotate relative to the base 14 about a first axis $X_1$, which is collinear with the longitudinal axis of the body 12.

In this embodiment, a light reflecting member 40 is located within the housing 20 for guiding light received from the aperture 26 towards the perforated sections 22 of the body 12. The light reflecting member 40 is illustrated in FIG. 6. The light reflecting member 40 comprises an annular upper end 42 and a recessed lower end 44 which receives a spigot 46 upstanding from the stop 30 to attach the stop 30 to the light reflecting member 40. The light reflecting member 40 may be attached to the internal surface of the housing 20 using an adhesive. The light reflecting member 40 is generally in the shape of an I-beam to provide structural support to the body 12, and is preferably formed from a metallic material, such as aluminium. The light reflecting member 40 comprises two concave reflective surfaces 48 arranged back to back, and which extend between the upper end 42 and the lower end 44 of the light reflecting member 40. When the light reflecting member 40 is inserted into the housing 20 and mounted on the spigot 46, each reflective surface 48 directs light that has entered the housing 20 through the aperture 26 towards a respective perforated section 22 of the body 12.

The support 16 is connected to the body 12 so that the support 16 extends outwardly from the body 12, preferably so that the support 16 is orthogonal to the longitudinal axis of the body 12. In this embodiment, the support 16 is connected to the upper end 24 of the body 12. The support 16 comprises a first joint section 50 which is attached to the upper end 24 of the body 12, for example using an adhesive so that the first joint section 50 is rigidly attached to the housing 20. The support 16 thus rotates with the body 12 about the first axis $X_1$. With reference again to FIG. 7, the first joint section 50 comprises an annular section 52 which has the same external diameter as the housing 20 so that together the housing 20 and the first joint section 50 have a unitary appearance, and which enables light to pass therethrough towards the aperture 26. The first joint section 50 may also include a pair of reflective surfaces 54, shown in FIG. 9, for guiding light towards the perforated sections 22 of the body 12.

The first joint section 50 comprises a hollow shaft 56 which extends outwardly from the annular section 52, preferably substantially orthogonally to the first axis $X_1$. A first arm 58 of the support 16 comprises a chamber 60 which extends the length of the first arm 58 and which receives the shaft 56 as a first end of the first arm 58 is slid on to the hollow shaft 56. The first arm 58 is then secured to the first joint section 50 using bolts or screws 62. The first arm 58 comprises two parallel side walls 64, a lower wall 66 located perpendicularly between the lower ends of the side walls 64, and an upper wall 68 which is parallel to the lower wall 66, and located generally midway between the upper end and lower end of the side walls 64. The chamber 60 is located between the lower wall 66 and the upper wall 68.

Figure 8:
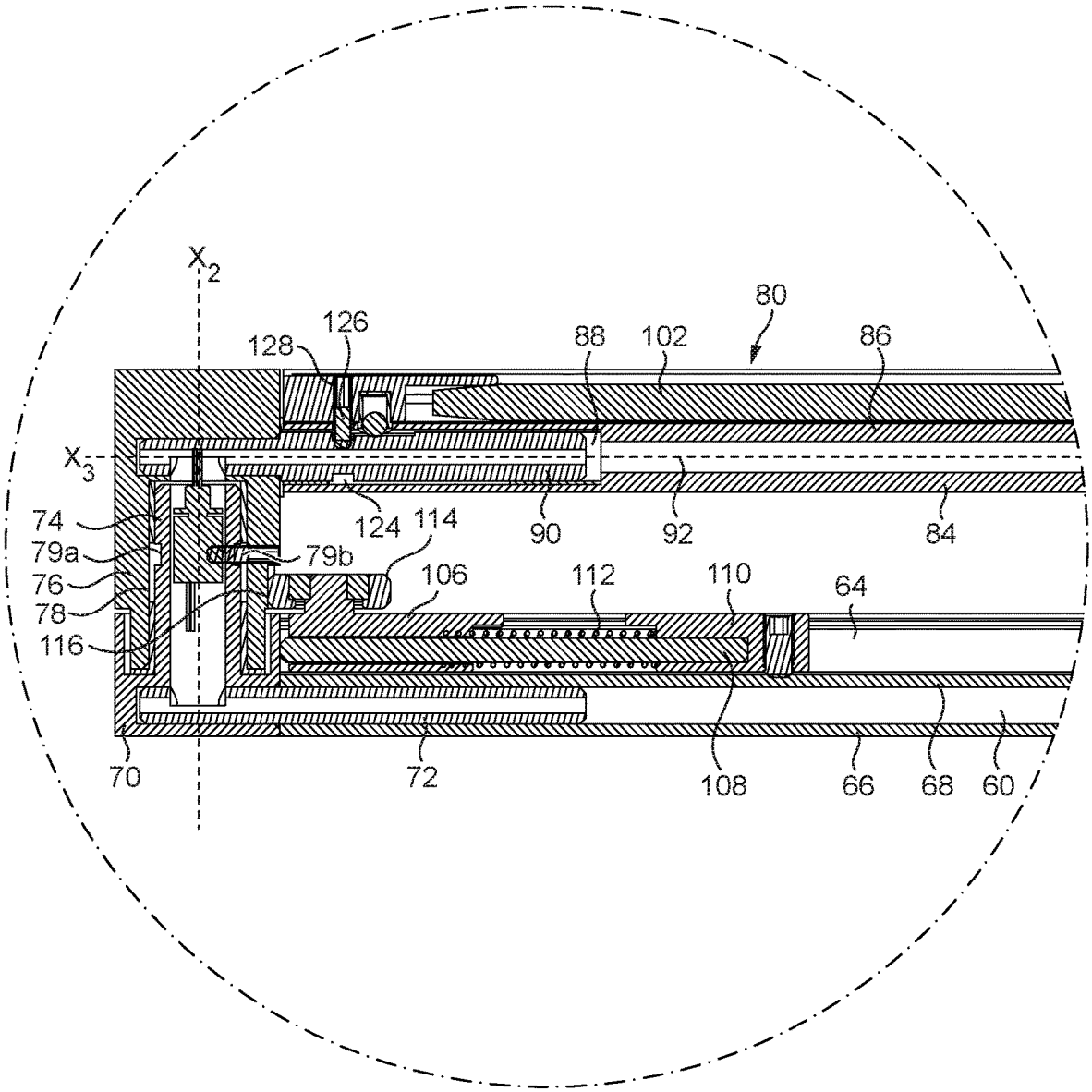
FIG. 8 is a close up of area C indicated in FIG. 7.

A second joint section 70 of the support 16 is connected to the second end of the first arm 58, for example using an adhesive. With reference also to FIG. 8, similar to the first joint section 50 the second joint section 70 comprises a hollow shaft 72 which is received by the chamber 60. The second joint section 70 comprises a generally cylindrical spigot 74 which, when the second joint section 70 is attached to the first arm 58 of the support 16, has a longitudinal axis which is parallel to the longitudinal axis of the body 12.

A third joint section 76 is mounted on the second joint section 70 so that the third joint section 76 is rotatable relative to the second joint section 70 about a second axis $X_2$ which is collinear with the longitudinal axis of the cylindrical spigot 74. The third joint section 76 is generally cylindrical in shape, and comprises a cylindrical recess 78 which receives the cylindrical spigot 74 as the third joint section 76 is mounted on the second joint section 70. The spigot 74 includes a circular recess 79*a* which receives a grub screw 79*b* carried by the third joint section 76 to retain the third joint section 76 on the second joint section 70 whilst preventing the third joint section 76 from lifting away from the second joint section 70 during use of the lighting device 10.

A second arm 80 of the support 16 is mounted on the third joint section 76 so that the second arm 80 pivots about the second axis $X_2$ with rotation of the third joint section 76 about that axis. Similar to the first arm 58, the second arm 80 comprises two parallel side walls 82, a lower wall 84 located perpendicularly between the lower ends of the side walls 82, and an upper wall 86 which is parallel to the lower wall 84, and located generally midway between the upper end and lower end of the side walls 82. The lower wall 84 and the upper wall 86 define a cylindrical recess 88 at one end of the second arm 80 which receives a hollow shaft 90 which extends outwardly from the third joint section 76 substantially orthogonal to the second axis $X_2$ so that the second arm 80 is substantially parallel to the first arm 58. This also enables the second arm 80 to rotate relative to the third joint section 76, and thus relative to the first arm 58, about a third axis $X_3$ which is orthogonal to, and which preferably intersects, the second axis $X_2$. The lower wall 84 and the upper wall 86 also define therebetween a chamber 92 which extends from the recess 88 to the second end of the second arm 80.

The light source 18 is mounted on the second end of the second arm 80. With reference to FIG. 7, the light source 18 comprises a plurality of light emitting diodes (LEDs) 94 centred on an optical axis O of the light source 18. The LEDs 94 are surrounded by an annular reflector housing 96 for directing light emitted from the LEDs 94 away from the light source 18. The LEDs 94 are mounted on a heat conductive plate 98, and connected electrically to a printed circuit board (PCB) 100. The PCB 100 is connected to one or more wires or conductive tracks which extend from the PCB 100 within the chambers 60, 92 and the hollow shafts 56, 72, 90 to an electrical contact (not shown) located on the first joint section 50. This electrical contact engages with an electrical contact (not shown) located on the upper end of the body 12 when the first joint section 50 is connected to the body 12. A further wire or conductive track extends through the body 12 to a further electrical contact located on the stop 30, to which a mains power supply may be connected. Providing these electrical contacts can enable the support 16 to be detachably connectable to the body 12 if so desired, for example for transportation purposes.

The heat conductive plate 98 is mounted on a heat pipe 102 so that heat emitted from the LEDs 94 during use of the lighting device 10 is transferred to the heat pipe 102. The heat pipe 102 protrudes outwardly from the light source 18, and is supported by the upper wall 86 of the second arm 80.

FIGS. 1 to 5 and FIGS. 7 to 8 illustrate the lighting device 10 in a first, or "room lighting" configuration. In this first configuration, the second arm 80 is oriented relative to the first arm 58 so that the second arm 80 is parallel to, and substantially overlies, the first arm 58. In this configuration, the light source 18 is positioned directly over the open upper end 24 of the body 12. The reflector housing 96 has substantially the same external diameter as the housing 20 of the body 12, and the heights of the joint sections 50, 70, 76 and the reflector housing 96 are chosen so that the open upper end 24 of the body 12 is substantially fully occluded by the light source 18, that is, so that there is substantially no stray light emitted from the lighting device 10 as it passes from the light source 18 and into the body 12. The light is reflected by the reflective surfaces within the body 12 towards the perforated sections 22 of the body 12, from which the light is emitted into the external environment. In this first configuration, heat radiated from the heat pipe 102 during use of the lighting device 10 passes through an aperture 104 located between the upper ends of the side walls 82 of the second arm 80 to enter the external environment.

Figure 9:
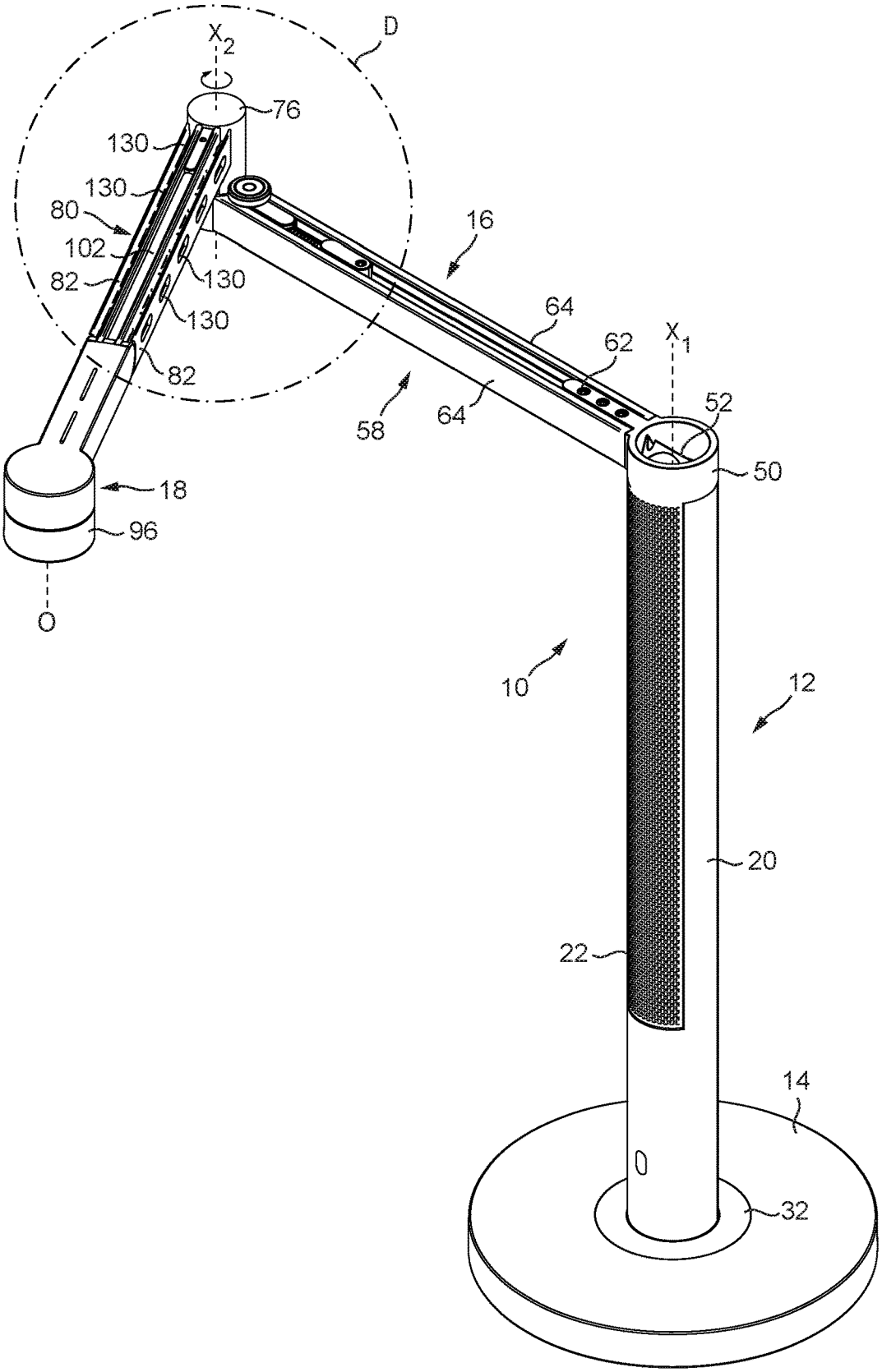
FIG. 9 is a perspective view, from above, of the lighting device, in which the lighting device is in a first task lighting configuration.
Figure 10:
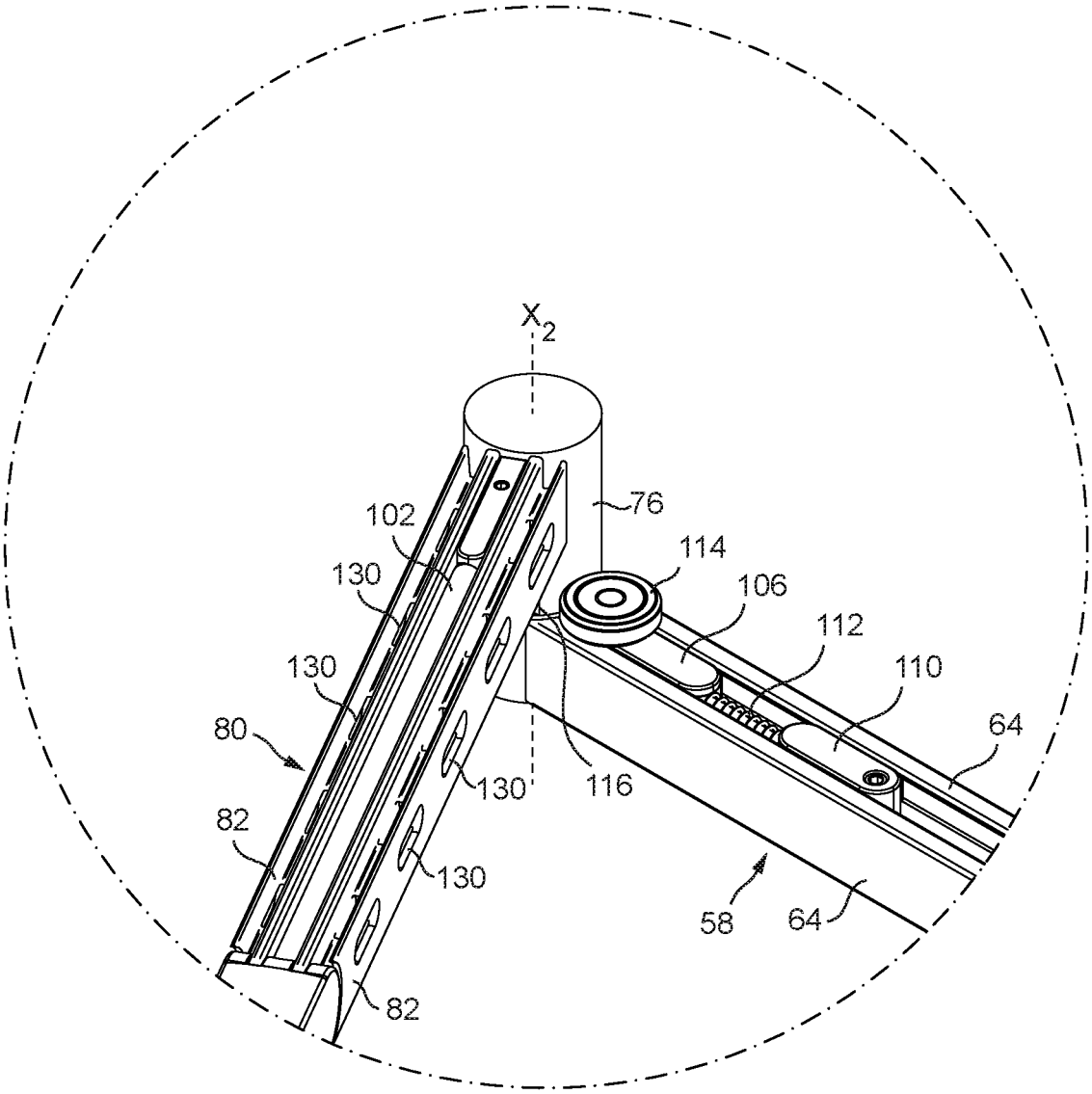
FIG. 10 is a close up of area D indicated in FIG. 9.
Figure 12:
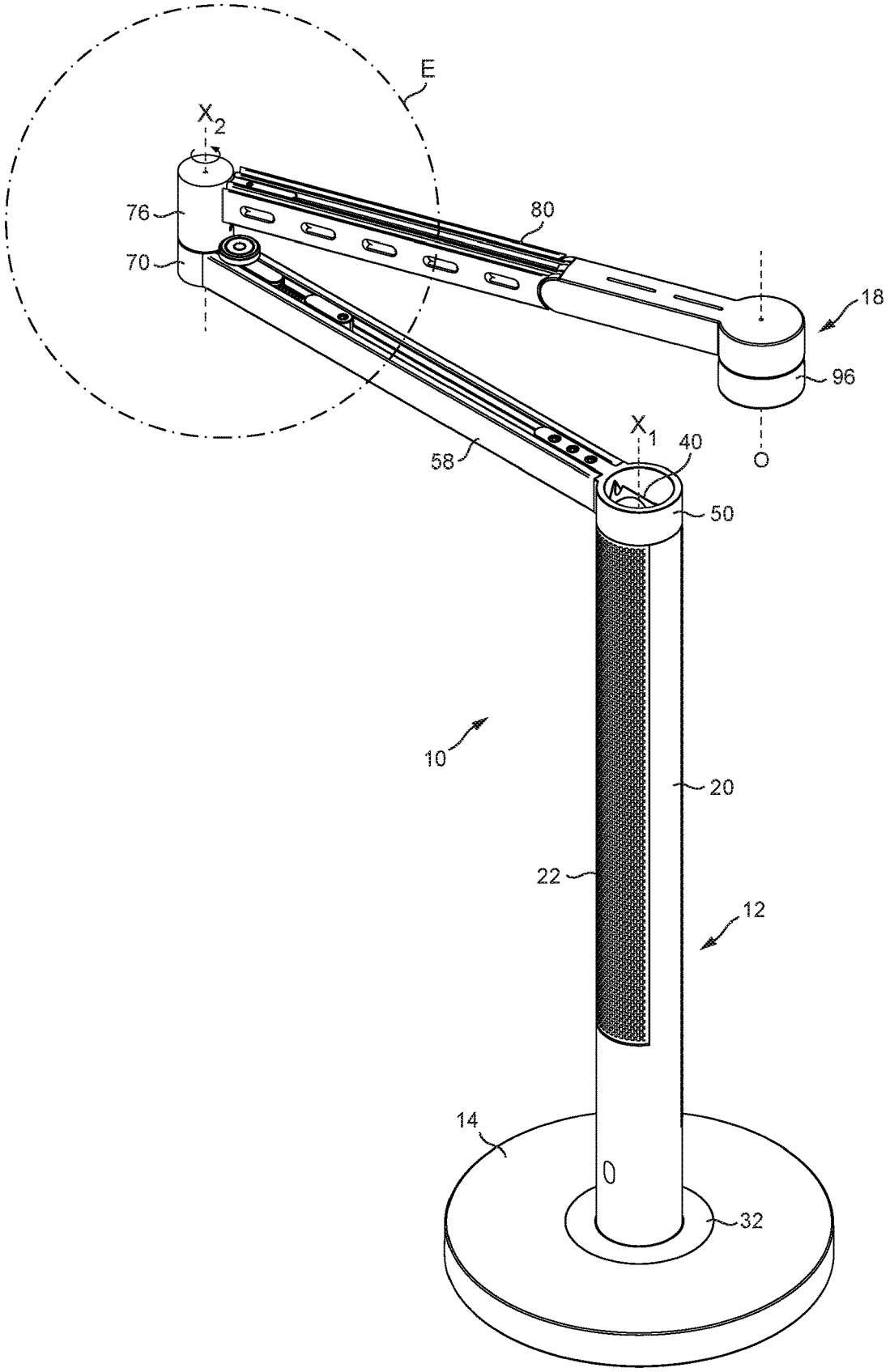
FIG. 12 is a perspective view, from above, of the lighting device, in which the lighting device is in a second task lighting configuration.
Figure 13:
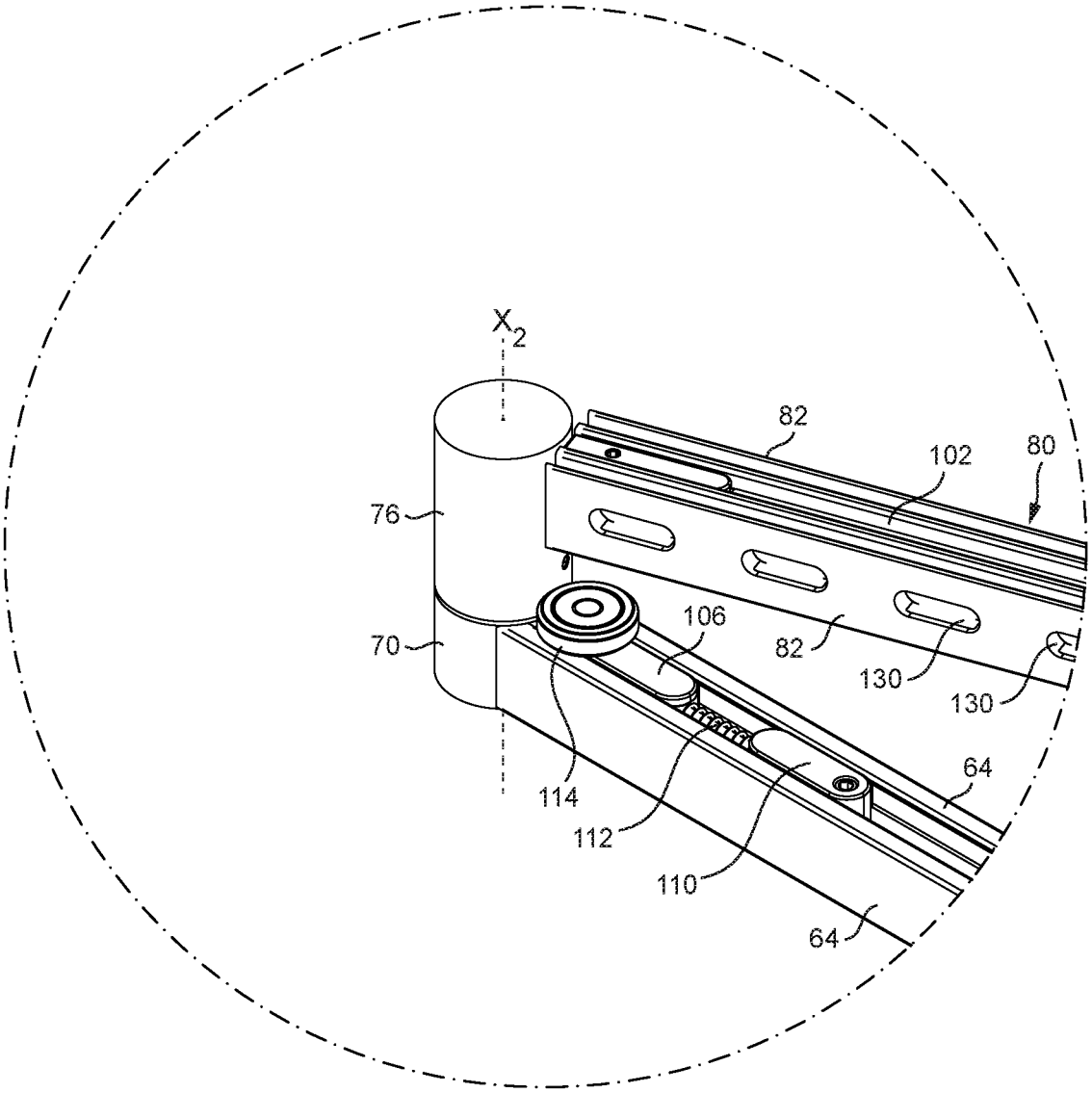
FIG. 13 is a close up of area E indicated in FIG. 12.
Figure 14:
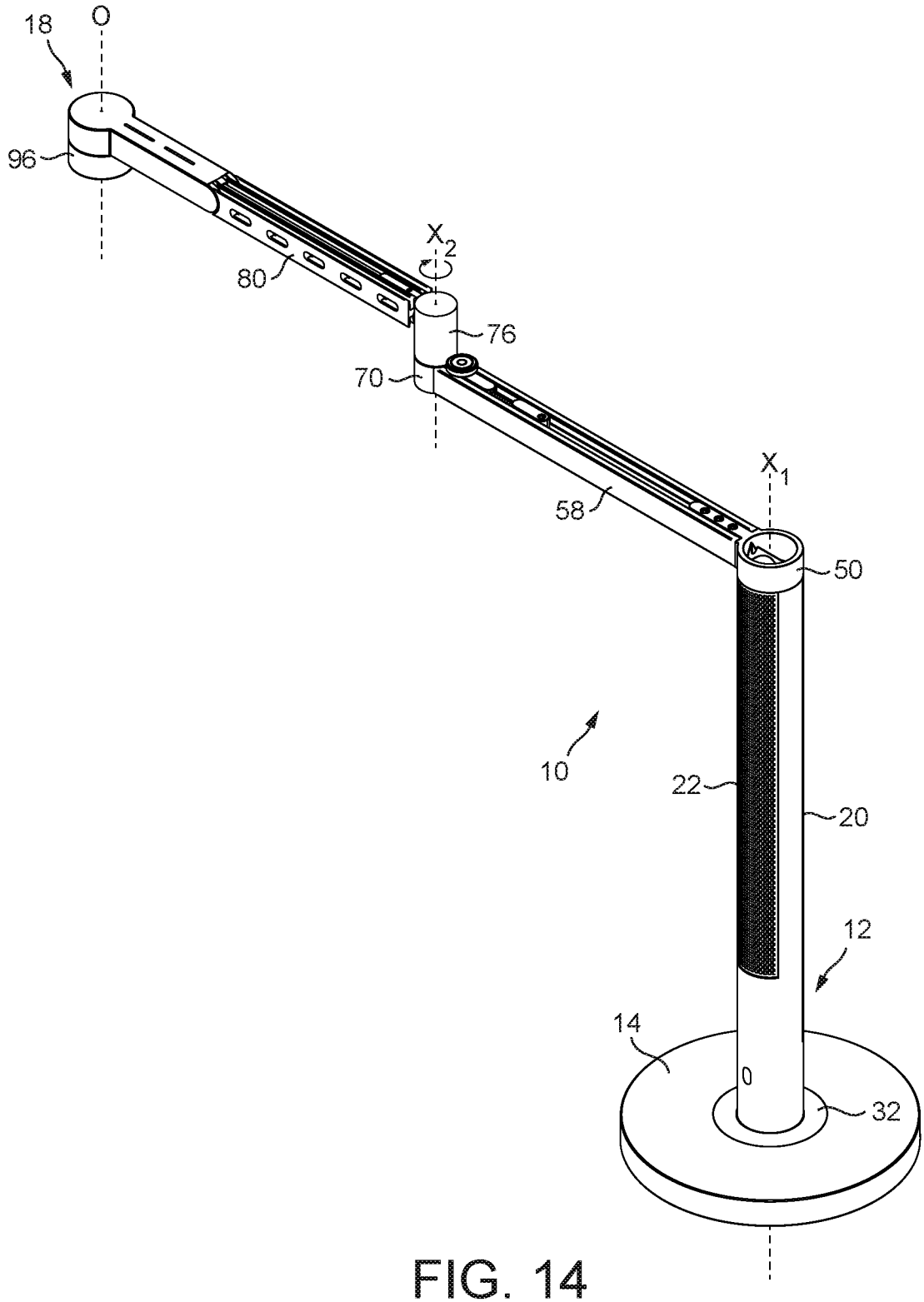
FIG. 14 is a perspective view, from above, of the lighting device, in which the lighting device is in a third, fully extended task lighting configuration.

From the first configuration, the second arm 80 may be rotated manually about the second axis $X_2$ so as to move the light source 18 laterally away from the open upper end 24 of the body 12, and so place the lighting device 10 in a second, "task lighting" configuration, in which the light emitted from the light source 10 can illuminate directly a work surface or other task area. By way of example, FIGS. 9 to 11 illustrate the lighting device 10 in a first tasking lighting configuration following a clockwise rotation of the second arm 80 about the second axis $X_2$, and FIGS. 12 to 13 illustrate the lighting device 10 in a second tasking lighting configuration following an anti-clockwise rotation of the second arm 80 about the second axis $X_2$. From either of these two configurations, the second arm 80 may be rotated further so that the lighting device 10 adopts a third, fully extended configuration, illustrated in FIG. 14, in which the first arm 58 and the second arm 80 are substantially parallel and linearly arranged, and the light source 18 is located furthest from the body 12. In any of these task lighting configurations, the user may adjust the angular position of the light source 18 relative to the base 14 by rotating the body 12 about the first axis $X_1$.

From each of these first to third task lighting configurations, the lighting device 10 may be returned to the room lighting configuration by rotation of the second arm 80 about the second axis $X_2$. To ensure an accurate alignment of the light source 18 with the body 12 as the lighting device 10 returns to its room lighting configuration, the lighting device 10 includes a biasing mechanism for urging the lighting device 10 into its room lighting configuration as the light source 18 approaches the body 12. In this embodiment, the biasing mechanism comprises a detent 106 which is located on the upper wall 68 of the first arm 58, and which is moveable along a rod 108 which extends between the second joint section 70 and a stop member 110 attached to the upper wall 68. A compression spring 112 extending about the rod 108 urges the detent 106 away from the stop member 110. The detent 106 includes a roller 114 which is urged against the external cylindrical surface of the third joint section 76, so that the roller 114 engages a circular track extending about the third joint section 76. The concave recess 116 is formed on the track. The recess 116 is positioned on the track so that the roller 114 is located in the recess 116 when the lighting device 10 is in its first configuration. As the lighting device 10 moves towards its first configuration, the roller 114 beings to enters the recess 116 and, under the biasing force of the spring 112, urges the third joint section 76 to rotate about the second axis $X_2$ until the roller 114 has fully entered the recess 116.

In each of the first to third task lighting configurations discussed above, the optical axis O of the light source 18 remains substantially parallel to the longitudinal axis of the body 12. These task lighting configurations are most useful for illuminating a task area on a work surface on which the lighting device 10 is located. At other times, the user may wish to illuminate other surfaces, such as reading material held by the user, or a wall or a ceiling of the room in which the lighting device 10 is located. In these instances, the user may change the orientation of the optical axis O of the light source 18 by rotating the second arm 80 about the third axis $X_3$.

Figure 15:
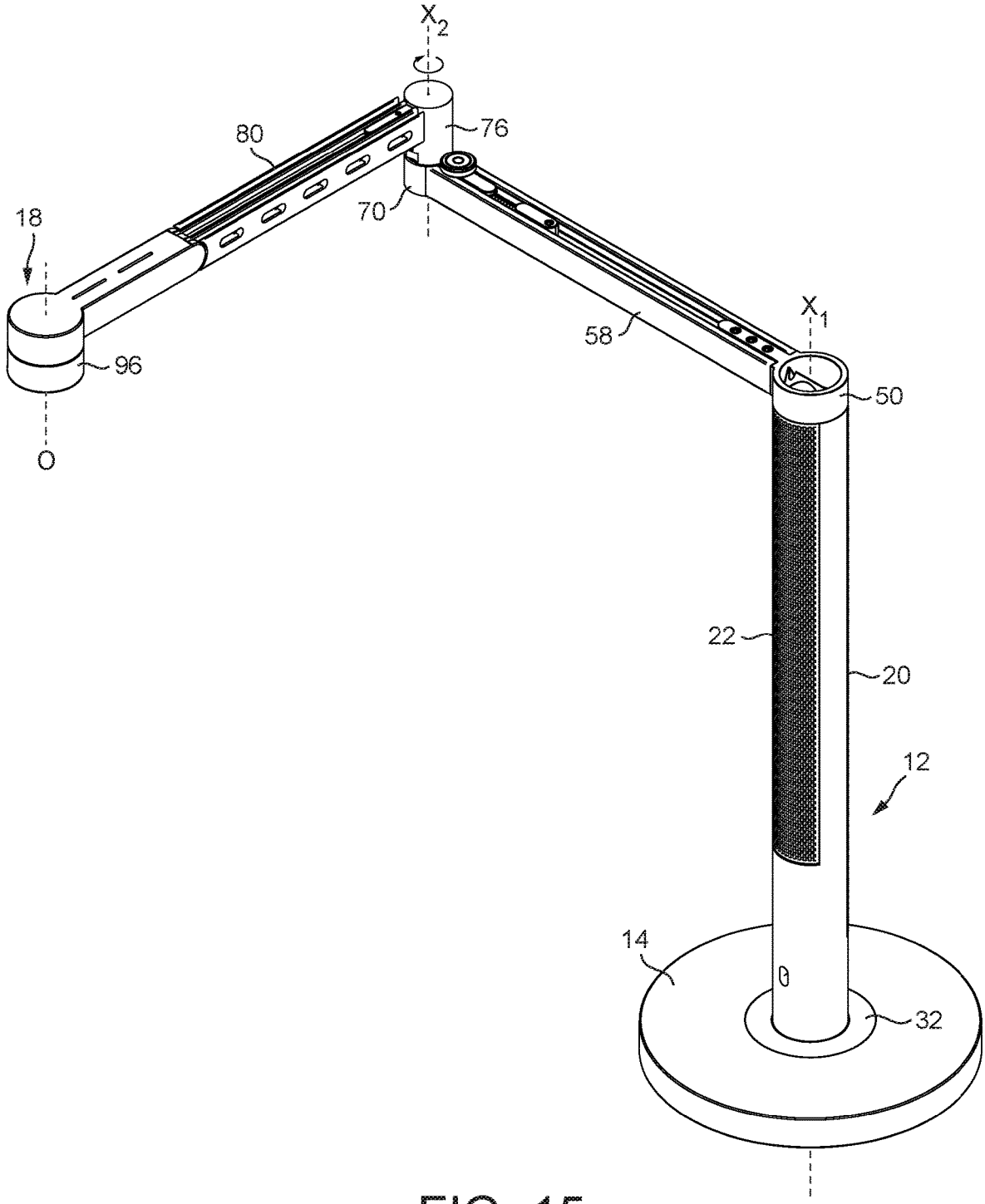
FIG. 15 is a perspective view, from above, of the lighting device, in which the lighting device is in a fourth task lighting configuration.
Figure 16:
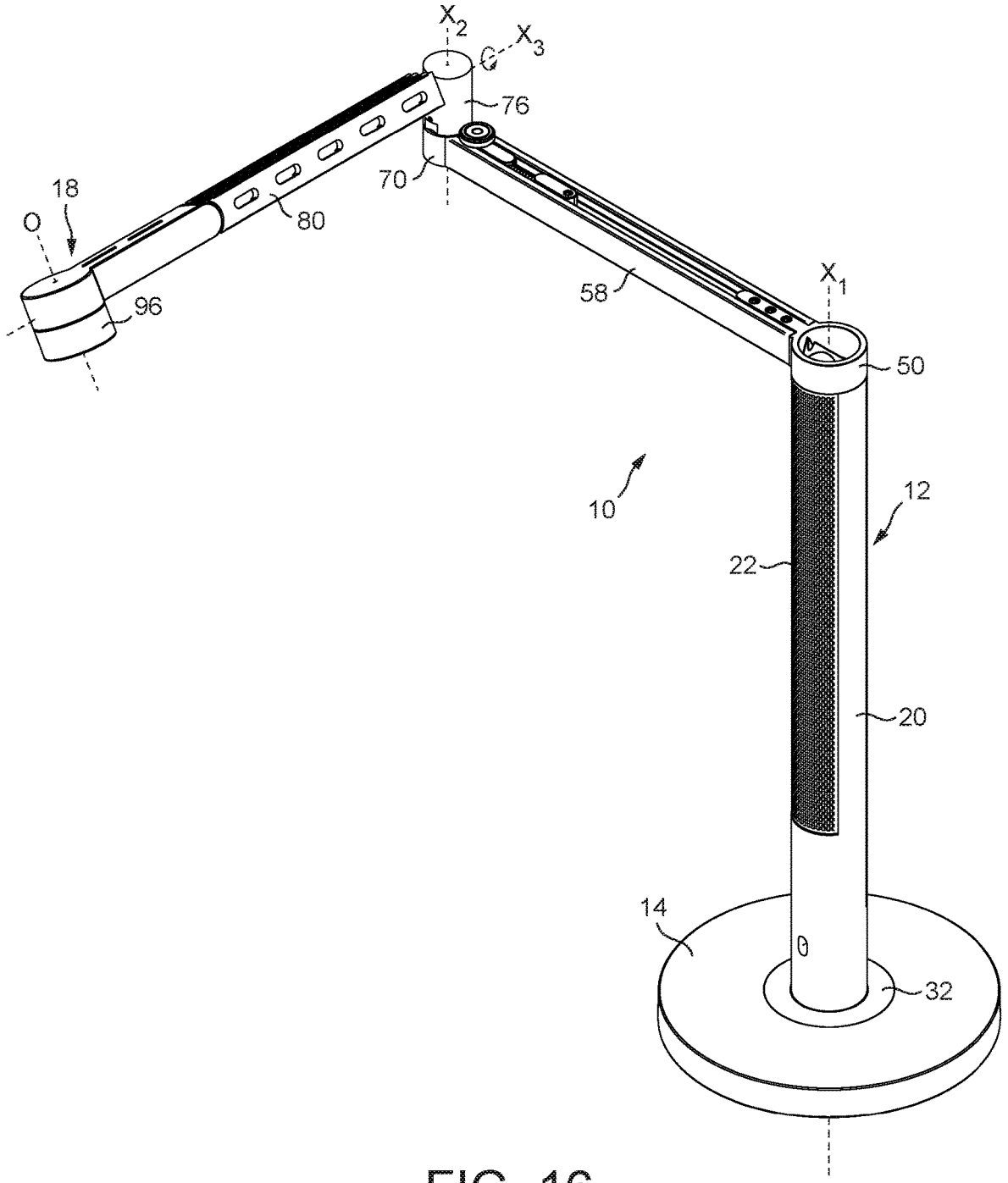
FIG. 16 is a perspective view, from above, of the lighting device, in which the lighting device is in a first angled configuration.
Figure 17:
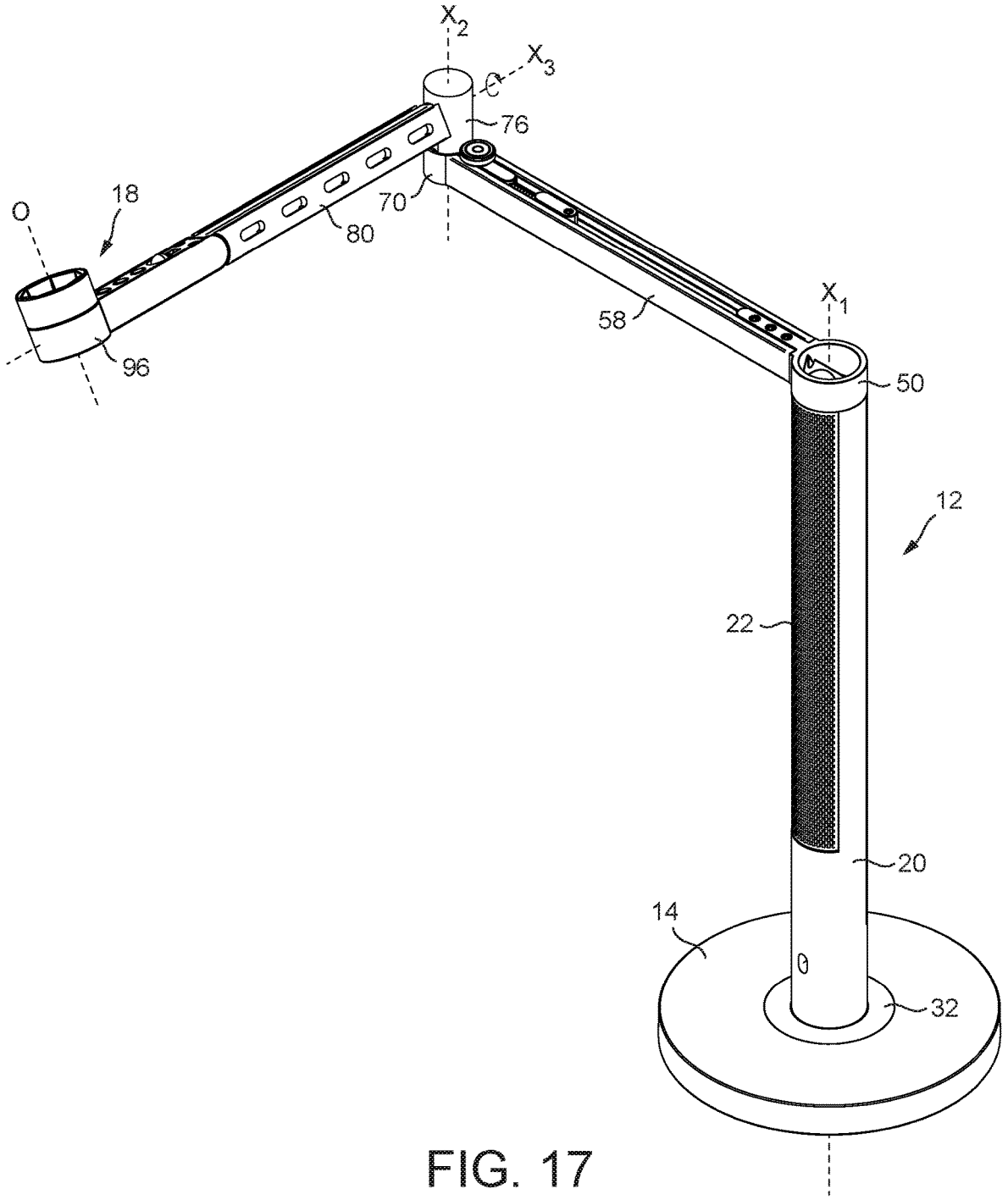
FIG. 17 is a perspective view, from above, of the lighting device, in which the lighting device is in a second angled configuration.
Figure 18:
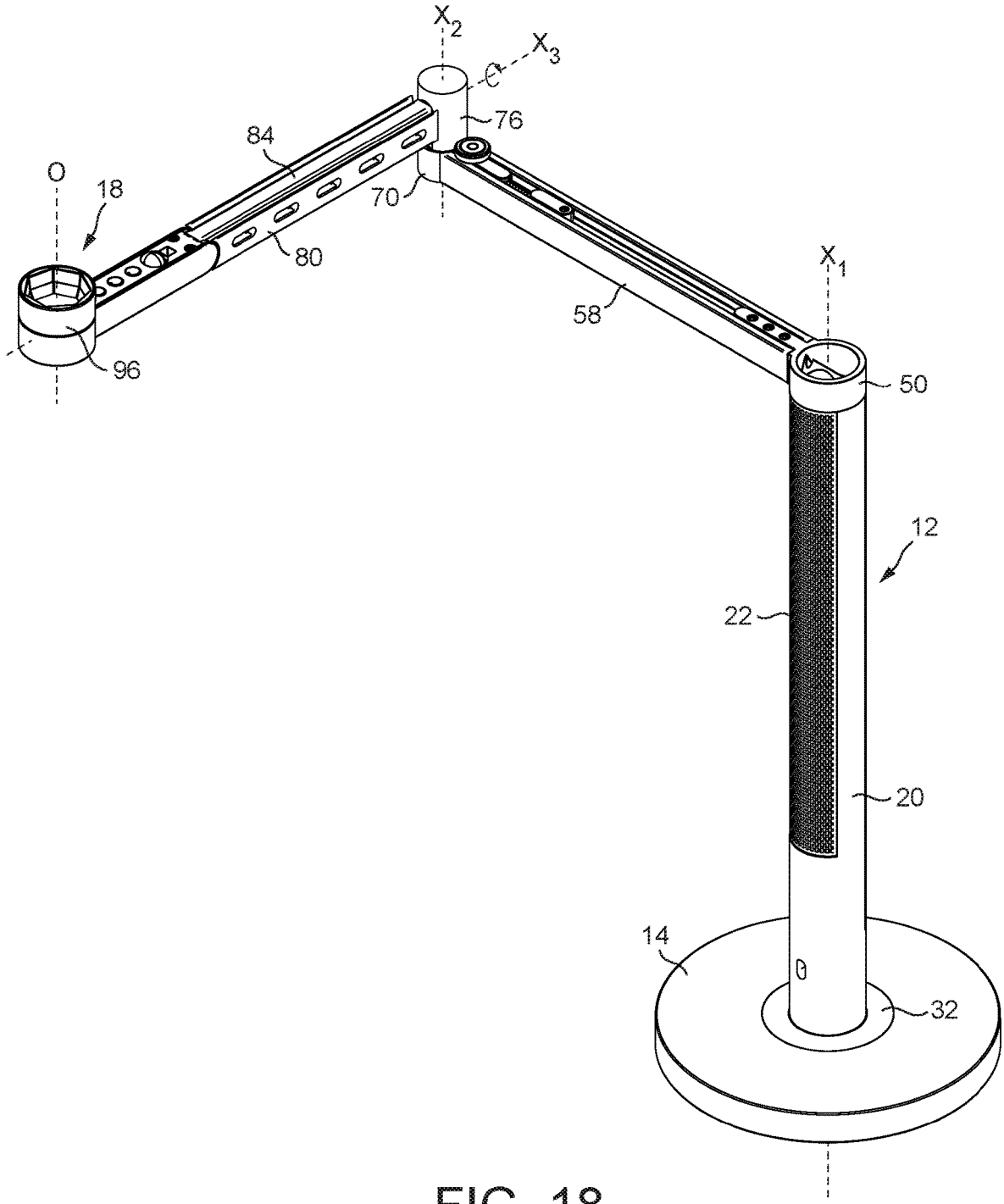
FIG. 18 is a perspective view, from above, of the lighting device, in which the lighting device is in an uplighting configuration.

By way of example, FIG. 15 illustrates the lighting device in a fourth task lighting configuration, in which, similar to the first to third task lighting configurations described above, the optical axis O is parallel to the longitudinal axis of the body 12 and the light source 18 is facing towards the work surface on which the lighting device 10 is located. This may be referred to as a downlighting configuration of the lighting device 10. To angle the optical axis O to the longitudinal axis of the body 12, the user grasps the second arm 80 and rotates it about the hollow shaft 90, and thus about the third axis $X_3$. By way of example, FIG. 16 illustrates the lighting device 10 in a first tasking lighting configuration following an anticlockwise rotation of the second arm 80 about the third axis $X_3$, and FIG. 17 illustrates the lighting device 10 in a second tasking lighting configuration following a clockwise rotation of the second arm 80 about the third axis $X_3$. From either of these two "angled" configurations, the second arm 80 may be rotated further about the third axis $X_3$ so that the lighting device 10 adopts an "uplighting" configuration, illustrated in FIG. 18, in which the optical axis O is again parallel to the longitudinal axis of the body 12 but the light source 18 is facing away from the work surface on which the lighting device 10 is located.

Again, as it is anticipated that the lighting device 10 may be more frequently used in either a downlighting configuration or an uplighting configuration, the lighting device 10 comprises a mechanism for retaining the lighting device in either of these two configurations. With reference to FIG. 8, the hollow shaft 90 includes recesses 124 which are formed in, and angularly spaced about, the outer surface of the hollow shaft 90. In this embodiment, the hollow shaft 90 comprises two recesses 124 which are angularly spaced by 180°, but further recesses 124 may be provided if so desired; for example, four recesses may be arranged about the hollow shaft 90 and angularly spaced by 90°. The second arm 80 includes a detent 126 which is biased by a spring 128 towards the hollow shaft 90, and so enters one of the recesses 124 when the lighting device 10 adopts either a downlighting or an uplighting configuration. The force of the spring 128 is selected so that the lighting device 10 remains in the selected configuration until the user grasps the second arm 80 of the support 16 and twists it about the third axis $X_3$ to urge the detent 126 away from the recess 124.

As in the first configuration, when the lighting device 10 is in a downlighting configuration heat radiated from the heat pipe 102 during use of the lighting device 10 passes through the aperture 104 located between the upper ends of the side walls 82 of the second arm 80 to enter the external environment. To improve the radiation of heat from the heat pipe 102 when the lighting device 10 is in an angled configuration, each side wall 82 of the second arm 80 comprises a series of apertures 130 through which heat radiated by the heat pipe 102 enters the external environment. As illustrated in FIGS. 9 and 12, for example, in this embodiment each side wall 82 comprises a row of five apertures 130. Each of these apertures 130 has substantially the same size and shape, and there is a substantially constant spacing between adjacent apertures 130 so that there is a relatively uniform heat emission along the side walls 82.

The invention claimed is:

1. A lighting device comprising:

a light source;

a base; and a support;

wherein the support comprises a first arm which is rotatable relative to the base about a first axis, a second arm upon which the light source is mounted, the second arm being substantially parallel to the first arm, the second arm comprising an upper wall and a lower wall that together define a recess, and a joint section which connects the second arm to the first arm for movement relative thereto about a second axis which is parallel to the first axis, the joint section comprising a shaft received in the recess of the second arm;

wherein the first arm of the support is mounted on a body which is rotatable relative to the base about the first axis, the first axis extending along a longitudinal axis of the body, the first arm of the support extending substantially orthogonal to the longitudinal axis of the body, and wherein the second arm is moveable around 360° about the shaft relative to the joint section about a third axis which is coaxial with the shaft and which intersects, and is orthogonal to, the second axis.

2. The device of claim 1, wherein the shaft comprises one or more shaft recesses angularly spaced about the shaft, and wherein the second arm comprising a detent which is received by one of the recesses depending on the orientation of the second arm.

3. The device of claim 2, wherein the shaft comprises two shaft recesses which are spaced apart by 180°, and which are arranged such that, when the detent is received by a shaft recess, an optical axis of the light source is parallel to the first axis.

4. The device of claim 1, wherein the joint section moves with the second arm about the second axis.

5. The device of claim 1, comprising a spigot which extends along the second axis, and wherein the joint section comprises a recess for receiving the spigot.

6. The device of claim 1, comprising at least one retainer for retaining the second arm in one or more orientations relative to the joint section.

* * * * *